US006991435B2

(12) United States Patent
Ochiai

(10) Patent No.: US 6,991,435 B2
(45) Date of Patent: Jan. 31, 2006

(54) VARIABLE DISPLACEMENT COMPRESSORS WHICH ESTIMATE AN INCLINATION ANGLE OF A PLATE OF THE COMPRESSOR

(75) Inventor: Yoshihiro Ochiai, Isesaki (JP)

(73) Assignee: Sanden Corporation, Gunma (JP)

( * ) Notice: Subject to any disclaimer, the term of this patent is extended or adjusted under 35 U.S.C. 154(b) by 330 days.

(21) Appl. No.: 10/441,236

(22) Filed: May 20, 2003

(65) Prior Publication Data

US 2004/0018097 A1 Jan. 29, 2004

(30) Foreign Application Priority Data

May 20, 2002 (JP) ..... 2002/144779

(51) Int. Cl.
*F04B 49/00* (2006.01)

(52) U.S. Cl. ..... 417/63; 417/222.1

(58) Field of Classification Search ..... 417/63, 417/222.1, 222.2

See application file for complete search history.

(56) References Cited

U.S. PATENT DOCUMENTS

| | | | | |
|---|---|---|---|---|
| 5,046,927 | A * | 9/1991 | Ohno et al. | 417/222.2 |
| 6,102,490 | A * | 8/2000 | Ko | 303/10 |
| 6,848,254 | B2 * | 2/2005 | Du | 60/448 |
| 6,848,888 | B2 * | 2/2005 | Du et al. | 417/53 |

FOREIGN PATENT DOCUMENTS

| | | |
|---|---|---|
| JP | 599156 | 4/1993 |
| JP | 5164045 | 6/1993 |

* cited by examiner

*Primary Examiner*—Charles G. Freay
(74) *Attorney, Agent, or Firm*—Baker Botts L.L.P.

(57) ABSTRACT

A variable displacement compressor includes a plate having a variable inclination angle, and a piston engaging the plate. The piston reciprocates within a bore of the compressor in accordance with a rotation of the plate, and the piston has a stroke length which is determined by the inclination angle of the plate. The compressor also includes a sensor positioned adjacent to the piston. The sensor generates an output signal when a predetermined portion of the piston is aligned with the sensor. The compressor also includes a processing unit operationally coupled to the sensor. The processing unit estimates the inclination angle of the plate based on the output signal from the sensor.

9 Claims, 3 Drawing Sheets

VARIABLE DISPLACEMENT COMPRESSORS WHICH ESTIMATE AN INCLINATION ANGLE OF A PLATE OF THE COMPRESSOR

BACKGROUND OF THE INVENTION

1. Field of the Invention

The present invention relates generally to variable displacement compressors. In particular, the present invention is directed towards compressors which estimate an inclination angle of a plate of the compressor to determine a driving torque of the compressor.

2. Description of Related Art

Known variable displacement compressors may be used in an air conditioning system of vehicle. Such known variable displacement compressors include a plate, e.g., a swash plate or a cam plate, and a piston which reciprocates within a cylinder bore. An inclination angle of the plate varies in response to an external signal, and the inclination angle determines a stroke length of the piston. Specifically, when the stroke length of the piston decreases, the amount of refrigerant which the piston compresses also decreases. Similarly, when the stroke length of the piston increases, the amount of refrigerant which the piston compresses also increases. Such known variable displacement compressors also determine a driving torque of a drive shaft of the compressor, and the external signal controls the inclination angle of the cam based on the determined driving torque. Such known compressors also use the determined driving torque to control the speed of an engine of the vehicle.

In a known variable displacement compressor described in Japanese Unexamined Patent Publication No. H05-164045, the driving torque is determined by using a magnetic film wrapped around the drive shaft, and a plurality of coils positioned adjacent to the magnetic film. When the drive shaft rotates, magnetostriction occurs in the magnetic film, which alters an output voltage of the coils. The driving torque of the drive shaft then is determined based on the output voltage of the coils. Nevertheless, in this known compressor, a torsional rigidity of the drive shaft is selected, such that the drive shaft readily may be twisted. The torsional rigidity of the drive shaft may be defined as the ratio of the torque applied about a centroidal axis of the drive shaft at a first end of the drive shaft to the resulting torsional angle, when a second end of the drive shaft is fixed. However, when the torsional rigidity of the drive shaft is selected, such that the drive shaft readily may be twisted, torsional vibration may occur. Torsional vibration may be defined as a periodic motion of the drive shaft in which the drive shaft is twisted about its axis first in first direction, and then in a second direction opposite to the first direction. This periodic motion may be superimposed on the rotational motion of the drive shaft. In addition, the drive shaft is subject to a bending force, and it is difficult to manufacture a drive shaft which is both readily twistable, and has a strength which is sufficient to retain its shape against the bending force. Moreover, the use of the coils increases the size and the cost of the compressor, and if the coils are not accurately positioned within the compressor, the determined driving torque may not be sufficiently accurate.

In another known variable displacement compressor described in Japanese Unexamined Patent Publication No. H05-99156, the driving torque is indirectly determined based on a pressure within the compressor, a temperature within the compressor, or a refrigerant flow-rate within the compressor, or combinations thereof. Nevertheless, the driving torque which is determined based on these measurements also may not be sufficiently accurate.

SUMMARY OF THE INVENTION

Therefore, a need has arisen for variable displacement compressors which overcome these and other shortcomings of the related art. A technical advantage of the present invention is that the drive torque may be determined based on an estimation of the inclination angle of the plate of the compressor, and the determined drive torque may be more accurate than in the known compressors.

In an embodiment of the present invention, a variable displacement compressor comprises a plate having a variable inclination angle, and a piston engaging the plate. The piston reciprocates within a bore of the compressor in accordance with a rotation of the plate, and the piston has a stroke length which is determined by the inclination angle of the plate. The compressor also comprises a sensor positioned adjacent to the piston. The sensor generates an output signal when at least one predetermined portion of the piston is aligned with the sensor. The compressor also comprises a processing unit operationally coupled to the sensor. The processing unit estimates the inclination angle of the plate based on at least the output signal from the sensor.

In another embodiment of the present invention, a method for estimating a driving torque of a compressor is provided. The compressor comprises a plate having a variable inclination angle, and a piston engaging the plate. The piston reciprocates within a bore of the compressor in accordance with a rotation of the plate, and the piston has a stroke length which is determined by the inclination angle of the plate. The method comprises the steps of estimating the inclination angle of the plate, and estimating the driving torque based on at least the inclination angle.

Other objects, features, and advantage will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF PREFERRED EMBODIMENTS

Figure 1:
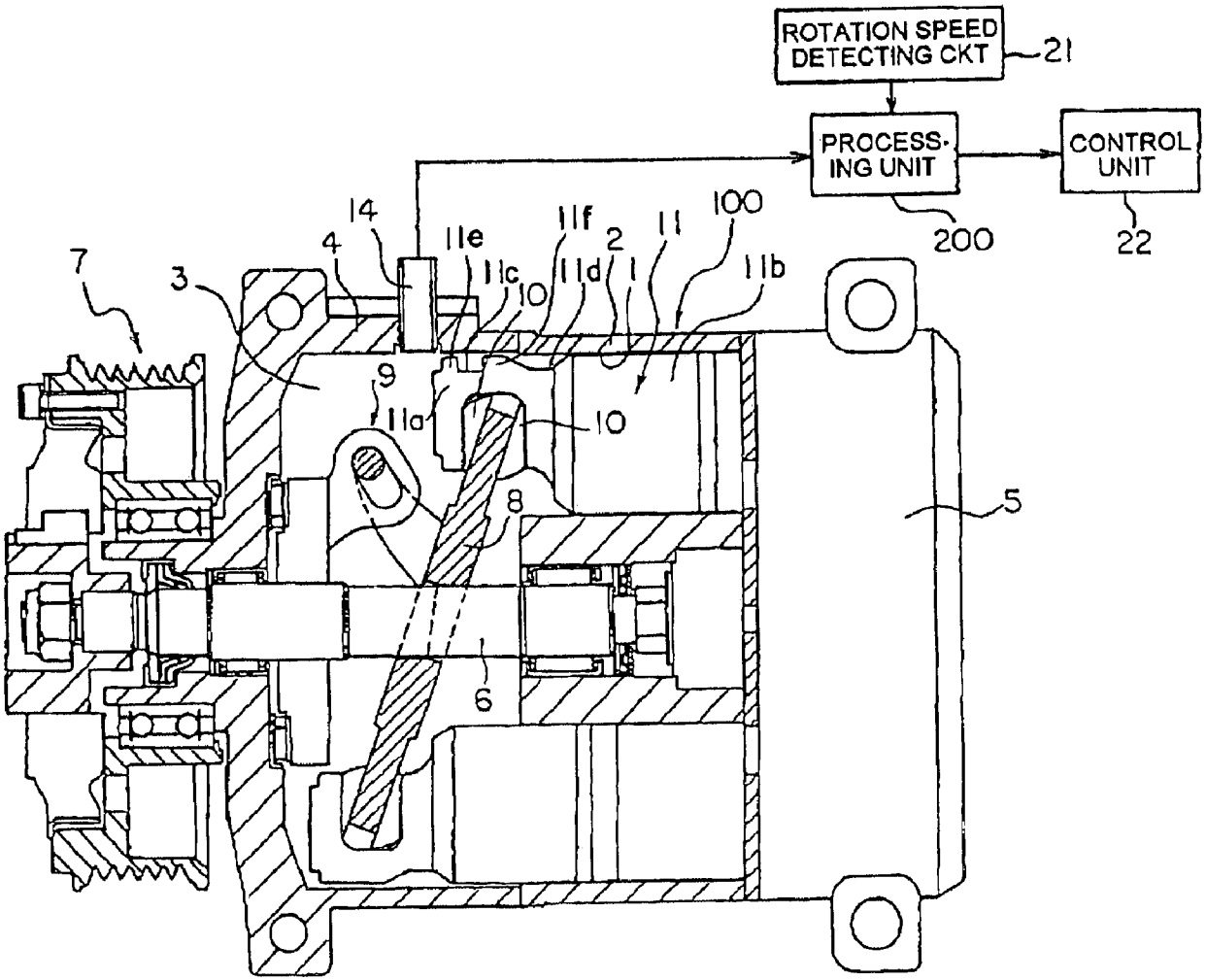
FIG. 1 is a cross-sectional view of a variable displacement compressor according to an embodiment of the present invention.
Figure 2:
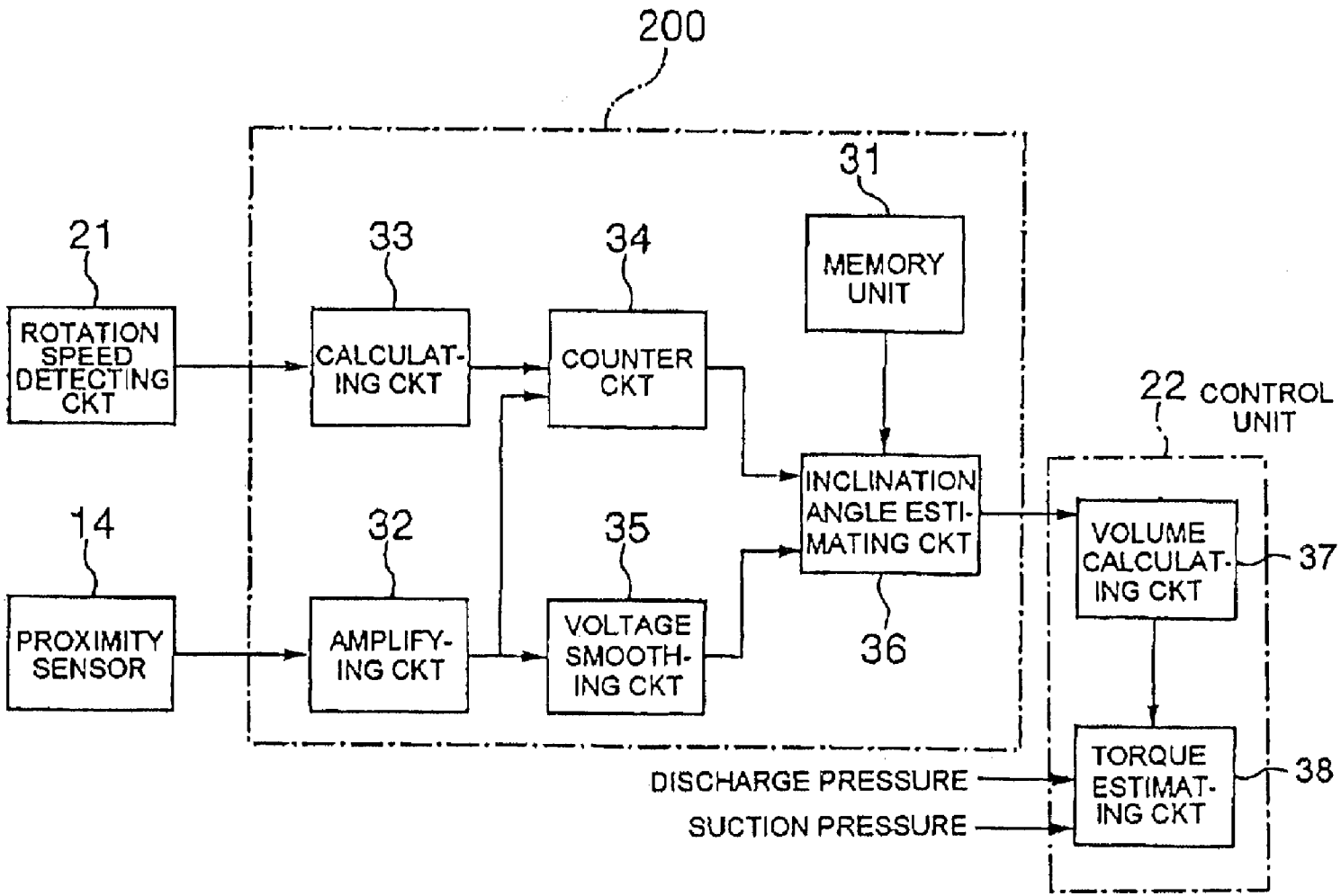
FIG. 2 is a block diagram of a processing circuit and a control unit of the compressor of FIG. 1, according to an embodiment of the present invention.
Figure 3:
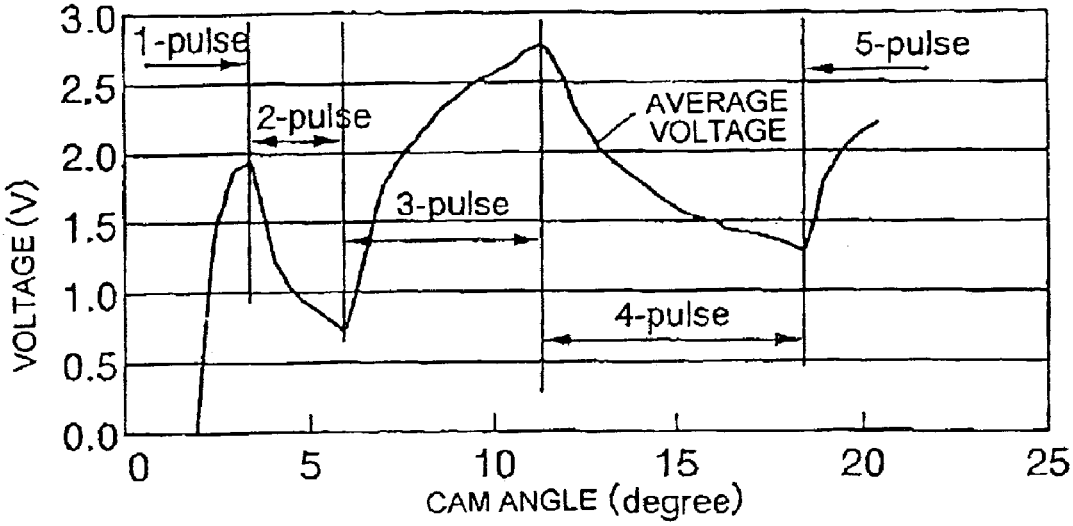
FIG. 3 is a graph depicting data stored in a memory unit of the processing circuit of FIG. 2, according to an embodiment of the present invention.

Preferred embodiments of the present invention and their features and advantages may be understood by referring to FIGS. 1–3, like numerals being used for like corresponding parts in the various drawings.

Referring to FIG. 1, a variable displacement compressor 100 according to an embodiment of the present invention is depicted. Compressor 100 may comprise a cylinder block 2 and a crankcase 4 fixed to a first end of cylinder block 2. Crankcase 4 may define a crank chamber 3. Cylinder block 2 and crankcase 4 may support a shaft 6, e.g., a drive shaft. Shaft 6 extends in an axial direction within compressor 100, and one end of shaft 6 penetrates crankcase 4 and is operationally coupled to a pulley 7. Pulley 7 transmits a rotational force from a driving source, e.g. an engine of a vehicle, to shaft 6.

Cylinder block 2 may have a plurality of cylinder bores 1 formed therein, and cylinder bores 1 may extend in an axial direction toward crank chamber 3. Compressor 100 also may comprise a plurality of pistons 11, and each piston 11 may be positioned within a corresponding one of cylinder bores 1, such that each piston 11 reciprocates independently within their corresponding cylinder bore 1. Each piston 11 may comprise a tail portion 11*a* and a head portion 11*b*, and each piston 11 may be manufactured from an aluminum alloy. Moreover, a valve plate (not numbered) may be fixed to cylinder block 2 to enclose each piston 11 within their corresponding cylinder bore 1. The valve plate may have a suction port (not numbered) and a discharge port (not numbered) formed therethrough, and a cylinder block 5 may be fixed to the valve plate. A suction chamber (not shown) and a discharge chamber (not shown) may be formed within cylinder head 5, and the suction chamber and the discharge chamber may be in refrigerant communication with cylinder bores 1 via a suction port (not numbered) and a discharge port (not numbered), respectively.

Compressor 100 also may comprise a plate 8, e.g., a cam plate or a swash plate, operationally coupled to shaft 6 via a hinge mechanism 9, such that an inclination angle of plate 8 may be varied. Compressor 100 also may comprise a plurality of shoe pairs 10, and a peripheral portion of plate 8 may be positioned between a first and a second shoe of shoe pair 10. Shoes pairs 10 may be supported by shoe supporters (not numbered) which are formed integrally with tail portion 11*a*, and each shoe 10 may slide on an inner surface of a corresponding one of the shoe supporters. Thus, plate 8 may be coupled to pistons 11 via shoes pairs 10. When shaft 6 rotates, plate 8 also rotates. Moreover, plate 8 slides between shoe pairs 10, and pistons 11 reciprocate within their corresponding cylinder bore 1. When pistons 11 move away from the suction chamber, pistons 11 draw a refrigerant, e.g., a liquid refrigerant or a refrigerant gas, from the suction chamber into the corresponding cylinder bore 1. Similarly, when pistons 11 move toward the suction chamber, piston 11 compresses the refrigerant within the corresponding cylinder bore 1, and discharge the compressed refrigerant into the discharge chamber. Moreover, the inclination angle of plate 8 determines a stroke length of pistons 11, and the stroke length of pistons 11 determines a discharge volume V of compressor 100. Specifically, when the stroke length of pistons 11 decreases, discharge volume V of compressor 100 also decreases. Similarly, when the stroke length of pistons 11 increases, discharge volume V of compressor 100 also increases.

In an embodiment of the present invention, compressor 100 also may comprise at least one sensor 14, e.g., at least one proximity sensor, positioned adjacent to at least one of pistons 11. For example, the at least one proximity sensor may be an edy-current type proximity sensor. The at least one piston 11 which sensor 14 is positioned adjacent to hereinafter is referred to as "selected piston 11." Tail portion 11*a* of selected piston 11 may comprise a first recess 11*c* and a second recess 11*d* formed therein. The distance between second recess 11*d* and piston head 11*b* may be less than the distance between first recess 11*c* and piston head 11*b*. Tail portion 11*a* of selected piston 11 also may comprise a first protrusion 11*e* and a second protrusion 11*f*. First protrusion 11*e* is formed between first recess 11*c* and a terminal end of tail portion 11*a*, and second protrusion 11*f* is formed between first recess 11*c* and second recess 11*d*. In an embodiment, sensor 14 may be positioned, such that first protrusion lie, first recess 11*c*, second protrusion 11*f*, second recess 11*d*, and piston head 11*b* are successively aligned with sensor 14 when the stroke length of piston 11 increases from a minimum stroke length to a maximum stroke length. Moreover, sensor 14 may be configured to discriminate first recess 11*c* and second recess 11*d* from first protrusion 11*e*, second protrusion 11*f*, and piston head 11*b*. For example, sensor 14 may generate an output signal when sensor 14 is aligned with from first protrusion 11*e*, second protrusion 11*f*, or piston head 11*b*, and sensor 14 may not generate an output signal when sensor 14 is aligned with first recess 11*c* or second recess 11*d*. In another example, sensor 14 may not generate an output signal when sensor 14 is aligned with from first protrusion 11*e*, second protrusion 11*f*, or piston head 11*b*, and sensor 14 may generate an output signal when sensor 14 is aligned with first recess 11*c* or second recess 11*d*. As such, when the stroke length of piston 11 increases from the minimum stroke length to the maximum stroke length, the output signal from sensor 14 may be a pulsed output signal, e.g., a substantially rectangular-shaped, pulsed output signal.

Compressor 100 also may comprise a processing circuit 200 operationally coupled to sensor 14, and a rotational speed detection circuit 21 for detecting the rotational speed of shaft 6. The rotational speed of shaft 6 may be equal to the rotational speed of plate 8, e.g., rotational speed detection circuit 21 may indirectly detect the rotational speed of plate 8, and processing circuit 200 may estimate the inclination angle of plate 8 based on the output signal from sensor 14 and the rotational speed of shaft 6. Processing circuit 200 then may transmit an inclination angle signal to a control unit 22, and the inclination angle signal is based on the estimated inclination angle of plate 8. Moreover, control unit 22 may control the stroke length of pistons 11 and the speed of the engine of the vehicle based on the inclination angle signal.

Referring to FIG. 3, while not willing to bound by a theory, it is believed that there is a relationship between an average voltage of the output signal from sensor 14, a pulse count during a single rotation of shaft 6, and the inclination angle of plate 8, and this relationship may be determined empirically. This relationship between the average voltage and the inclination angle of plate 8 during each pulse count may be stored as data in a memory unit 31 of processing circuit 200. Moreover, the inclination angle of plate 8 may be estimated by comparing the average voltage and the pulse count with the data stored in memory unit 31. For example, when the average voltage is about 2.6 Volts and the pulse count is three pulses, then the inclination angle may be about 10°. The pulse count may be the number of pulses in the output signal during a single rotation of shaft 6. Because the rotational speed of shaft 6 may be equal to the rotational speed of plate 8, the pulse count also may be the number of pulses in the output signal during a single rotation of plate 8.

Referring to FIG. 2, a block diagram of processing circuit 200 and control unit 22 according to an exemplary embodiment of the present invention are depicted. Processing circuit 200 may comprise an amplifying circuit 32 operationally e.g., mechanically, electrically, or electromechanically, coupled to sensor 14 for amplifying the output signal from sensor 14. Processing circuit also may comprise a cycle calculating circuit 33 operationally coupled to rotational speed detecting circuit 21 for calculating a rotational cycle of shaft 6. Moreover, processing circuit 200 may comprise a counter circuit 34 operationally coupled to amplifying circuit 32 and cycle calculating circuit 33 for generating the pulse count during the rotational cycle of shaft 6. Processing circuit 200 further may comprise voltage smoothing circuit 35 operationally coupled to amplifying circuit 32 for averaging the voltage of the output signal of sensor 14 to generate the average voltage. Processing circuit 200 also may comprise an inclination angle estimating circuit 36 operationally coupled to memory unit 31, counter circuit 34, and voltage smoothing circuit 35. Inclination angle estimating circuit 36 may estimate the inclination angle of plate 8 based on the average voltage, the pulse count, and the data stored in memory unit 31. The inclination angle estimating circuit 36 then transmits the inclination angle signal to control unit 22.

In an embodiment of the present invention, control unit 22 may comprise a volume calculating circuit 37 operationally coupled to processing circuit 200. Control unit 22 also may comprise a torque estimating circuit 38 operationally coupled to volume calculating circuit 37. Volume calculating circuit 37 may calculate a discharge volume V of compressor 100 per rotation of shaft 6, e.g., based on the formula $V=S\cdot L\cdot n$, where S is the cross-sectional area of piston 11; L is the stroke length of piston 11, which is estimated based on the inclination angle of plate 8; and n is the number of cylinder bores 1. Volume calculating circuit 37 then may transmit a discharge volume signal to torque estimating circuit 38. Torque estimating circuit 38 also may receive a signal indicating the discharge pressure $P_d$ within compressor 100, and a signal indicating the suction pressure $P_s$ within compressor 100. Moreover, torque estimating circuit 38 may estimate the driving torque T based on discharge pressure $P_d$, suction pressure $P_s$, and discharge volume V, e.g., based on the formula $T=K\cdot P_s\cdot[(P_d/P_s)^m-1]\cdot V$, where K and m are constants.

While the invention has been described in connection with preferred embodiments, it will be understood by those skilled in the art that variations and modifications of the preferred embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A variable displacement compressor comprising:

a plate having a variable inclination angle;

a piston engaging the plate, wherein the piston reciprocates within a bore of the compressor in accordance with a rotation of the plate, and the piston has a stroke length which is determined by the inclination angle of the plate;

a sensor positioned adjacent to the piston, wherein the sensor generates an output signal when at least one predetermined portion of the piston is aligned with the sensor; and a processing unit operationally coupled to the sensor, wherein the processing unit estimates the inclination angle of the plate based on at least the output signal from the sensor.

2. The compressor of claim 1, wherein the piston comprises:

a piston head; and a piston tail connected to the piston head, wherein the piston tail engages the plate.

3. The compressor of claim 2, wherein the piston head or the piston tail comprises at least one recess formed therein, and the at least one predetermined portion of the piston comprises the at least one recess.

4. The compressor of claim 2, wherein the piston head or the piston tail comprises at least one recess formed therein, and at least one piston surface positioned outside the recess, wherein the at least one predetermined portion of the piston comprises the at least one piston surface.

5. The compressor of claim 1, wherein the piston comprises:

a first portion;

a second portion; and a third portion, wherein the second portion is positioned between the first portion and the third portion, and the at least one predetermined portion of the piston comprises the first portion and the third portion, such that the output signal is a pulsed output signal.

6. The compressor of claim 5, wherein the processing unit comprises:

a counter circuit for generating a pulse count of the output signal, wherein the counter circuit is operationally coupled to the sensor;

a voltage smoothing circuit for averaging a voltage of the output signal to generate an average voltage of the output signal, wherein the voltage smoothing circuit is operationally coupled to the sensor; and an inclination angle estimating circuit for estimating the inclination angle of the plate based on at least the average voltage and the pulse count, wherein the inclination angle estimating circuit is operationally coupled to each of the counter circuit and the voltage smoothing circuit.

7. The compressor of claim 6, further comprising a rotational speed detection circuit for directly or indirectly detecting a rotational speed of the plate, wherein the processing unit further comprises a cycle calculating circuit for calculating a rotational cycle of the plate, wherein the cycle calculating circuit is operationally coupled to the rotational speed detection circuit and the counter circuit.

8. The compressor of claim 7, wherein the processing unit further comprises a memory unit for storing data associated with a predetermined relationship between the inclination angle, the pulse count, and the average voltage, wherein the memory unit is operationally coupled to the inclination angle estimating circuit, and the inclination angle estimating circuit estimates the inclination angle based on the average voltage, the pulse count, and the data associated with the predetermined relationship.

9. The compressor of claim 1, further comprising:

a volume calculating circuit for calculating a discharge volume of the compressor, wherein the volume calculating circuit is operationally coupled to the processing unit.

* * * * *